US008061176B2

(12) United States Patent
Takayama et al.

(10) Patent No.: US 8,061,176 B2
(45) Date of Patent: Nov. 22, 2011

(54) PRESS MOLDING DEVICE AND PRESS MOLDING METHOD

(75) Inventors: Norihiro Takayama, Toyota (JP); Yasuhito Hanaki, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 840 days.

(21) Appl. No.: 11/885,179

(22) PCT Filed: Feb. 15, 2006

(86) PCT No.: PCT/JP2006/303105

§ 371 (c)(1),
(2), (4) Date: Jun. 4, 2008

(87) PCT Pub. No.: WO2006/092989

PCT Pub. Date: Sep. 8, 2006

(65) Prior Publication Data

US 2011/0154878 A1 Jun. 30, 2011

(30) Foreign Application Priority Data

Feb. 28, 2005 (JP) ..... 2005-053085

(51) Int. Cl.
*B21D 22/00* (2006.01)

(52) U.S. Cl. ..... 72/351; 72/347; 72/453.13; 72/456

(58) Field of Classification Search ..... 72/347, 72/350, 351, 453.13, 343, 344, 455, 456; 100/244, 259, 269.02, 269.03
See application file for complete search history.

(56) References Cited

U.S. PATENT DOCUMENTS

| | | | | |
|---|---|---|---|---|
| 4,745,792 | A * | 5/1988 | Story et al. | 72/351 |
| 5,941,110 | A * | 8/1999 | Cao et al. | 72/21.4 |
| 6,276,185 | B1 * | 8/2001 | Owens | 72/350 |

FOREIGN PATENT DOCUMENTS

| | | |
|---|---|---|
| EP | 0 692 323 | 1/1996 |
| EP | 0 726 105 | 8/1996 |
| JP | 61-176429 | 8/1986 |
| JP | 63-013626 | 1/1988 |
| JP | 63-80928 | 4/1988 |
| JP | 63-168232 | 7/1988 |
| JP | 6-54422 | 7/1994 |
| JP | 2002-086219 | 3/2002 |
| JP | 2006-35289 | 2/2006 |
| JP | 2006-159237 | 6/2006 |

OTHER PUBLICATIONS

International Search Report, Mar. 2007.
U.S. Appl. No. 11/629,479, Issued Jun. 2009.
Extended European Search Report for EP Appl. No. 06714245.5 dated Aug. 24, 2010.

* cited by examiner

*Primary Examiner* — Edward Tolan
(74) *Attorney, Agent, or Firm* — Finnegan, Henderson, Farabow, Garrett & Dunner, LLP

(57) ABSTRACT

A press molding device, which has a die 2, a punch 3 and a cushion ring constituted by a first cushion ring 5 and a second cushion ring 6, is characterized in that the first cushion ring 5 is disposed around the punch 3, the punch 3 has a void 3*c* which houses the second cushion ring 6, and the second cushion ring 6 is housed in the void 3*c* of the punch 3 and has a reinforcing structure 50 maintaining posture of the second cushion ring 6.

7 Claims, 8 Drawing Sheets

PRESS MOLDING DEVICE AND PRESS MOLDING METHOD

TECHNICAL FIELD OF THE INVENTION

The present invention relates to a press molding device, having a die, a punch and a cushion ring, and a press molding method. Especially, the present invention relates to the construction improving rigidity of the cushion ring.

BACKGROUND ART

Conventionally, there is well known a press molding device for drawing process having a die, a punch and a cushion ring that a work piece is pressed to the punch facing the die while the work piece is pinched by the die and the cushion ring so as to perform molding process. For instance, an example of the device is described in the Japanese Patent Laid Open Gazette 2002-86219.

Such a press molding device may have plural cushion rings. For example, a press molding device shown in FIG. 11 comprises a die 102 which is an upper mold, a punch 103 facing the die 102, a lower mold 104 constructed integrally with the punch 103, a first cushion ring 105 which is a ring-shaped member arranged around the punch 103, and a second cushion ring 106 arranged at the inner peripheral side of the first cushion ring 105.

Then, at the time that the die 102 is moved downward so as to perform molding, a work piece W interposed between the die 102 and the punch 103 is pinched by a pressure surface 102*a* of the die 102, a pressure surface 105*a* of the first cushion ring 105 and a pressure surface 106*a* of the second cushion ring 106 so as to prevent crease and crack of the work piece W.

At the time of molding by the above-mentioned press molding device, the die 102 is moved downward and the work piece W is pinched by the pressure surface 102*a* of the die 102, the pressure surface 105*a* of the first cushion ring 105 and the pressure surface 106*a* of the second cushion ring 106, and then the die 102 is moved downward further so that the work piece W is pressed to the punch 103 and is deformed, whereby the work piece W is processed to be molded. The work piece W is pinched completely by the punch 103 and the die 102 so as to finish the processing.

In the case that the work piece W is pressed to the punch 103 to be molded, the contact area between the inner second cushion ring 106 and the other members is small so that the posture of the second cushion ring 106 is unstable. Then, the regular posture may not be maintained and disorder may occur, thereby causing slant or the like. When the second cushion ring 106 is slanted, abnormal abrasion of the punch 103 and the die 102 and defects of the work piece W after processed such as crease and crack are liable to occur.

SUMMARY OF THE INVENTION

A press molding device solving the above-mentioned problem has below features.

With regard to the present invention, a press molding device, which has a die, a punch and a cushion ring constituted by a first cushion ring and a second cushion ring, is characterized in that the first cushion ring is disposed around the punch, the punch has a void which houses the second cushion ring, the second cushion ring is housed in the void of the punch and is movable vertically, and a reinforcing structure maintaining posture of the second cushion ring to the horizontal direction is provided between the second cushion ring and the die.

Accordingly, even if force to the horizontal direction is applied on the second cushion ring at the time of molding process of a work piece, the disorder of posture of the second cushion ring to the horizontal direction such as lateral movement or slant is suppressed. Therefore, abnormal abrasion of the punch and the die and defects of the work piece after processed such as crease and crack are prevented.

The crease and crack of the work piece after the molding process can be suppressed without troublesome adjustment work or the like, thereby improving the accuracy of molding process and quality of the work piece.

partial abrasion of a slide plate which is a guide member attached to the second cushion ring is prevented, thereby extending life of the construction members of the press molding device such as the slide plate.

With regard to the present invention, the reinforcing structure is provided between the second cushion ring and the die.

Accordingly, the reinforcing structure serves as a guide of attachment of the die at the time of attaching the die to the press molding device, thereby easing the attachment work of the die.

With regard to the present invention, the reinforcing structure is provided between the second cushion ring and a bolster on which the second cushion ring is mounted.

Accordingly, the reinforcing structure serves as a guide of attachment of the second cushion ring at the time of attaching the second cushion ring to the bolster, thereby easing the attachment work of the die.

With regard to the present invention, the reinforcing structure comprises a guide post and a guide bush supporting the guide post slidably.

Accordingly, the disorder of posture of the second cushion ring to the horizontal direction such as lateral movement or slant is suppressed effectively with simple construction.

With regard to the present invention, the disorder of posture of the second cushion ring is suppressed, thereby preventing abnormal abrasion of the punch and the die and defects of the work piece after processed such as crease and crack.

The crease and crack of the work piece after the molding process can be suppressed without troublesome adjustment work or the like, thereby improving the accuracy of molding process and quality of the work piece.

Furthermore, life of the construction members of the press molding device such as the slide plate which is a guide member attached to the second cushion ring is extended.

With regard to a press molding method of the present invention, a cushion ring is constituted by a first cushion ring and a second cushion ring, the first cushion ring is disposed around the punch, the punch has a void which houses the second cushion ring, the second cushion ring is housed in the void of the punch and is guided movably vertically, and a reinforcing structure maintaining posture of the second cushion ring to the horizontal direction by fit is provided between the second cushion ring and the die.

With regard to the press molding method of the present invention, the press molding device is used that the reinforcing structure is provided between the second cushion ring and the die.

With regard to the press molding method of the present invention, the press molding device is used that the reinforcing structure is provided between the second cushion ring and a bolster on which the second cushion ring is mounted.

With regard to the press molding method of the present invention, the press molding device is used that the reinforcing structure comprises a guide post and a guide bush supporting the guide post slidably.

By using the press molding method of the present invention, the maintenance of the regular posture is eased at the time of molding process, whereby the posture is stabilized. Occurrence of abnormal abrasion and crease and crack of the work piece after processed are suppressed.

BEST MODE FOR CARRYING OUT THE INVENTION

Next, explanation will be given on embodiments of the present invention in connection with the accompanying drawings.

Figure 1:
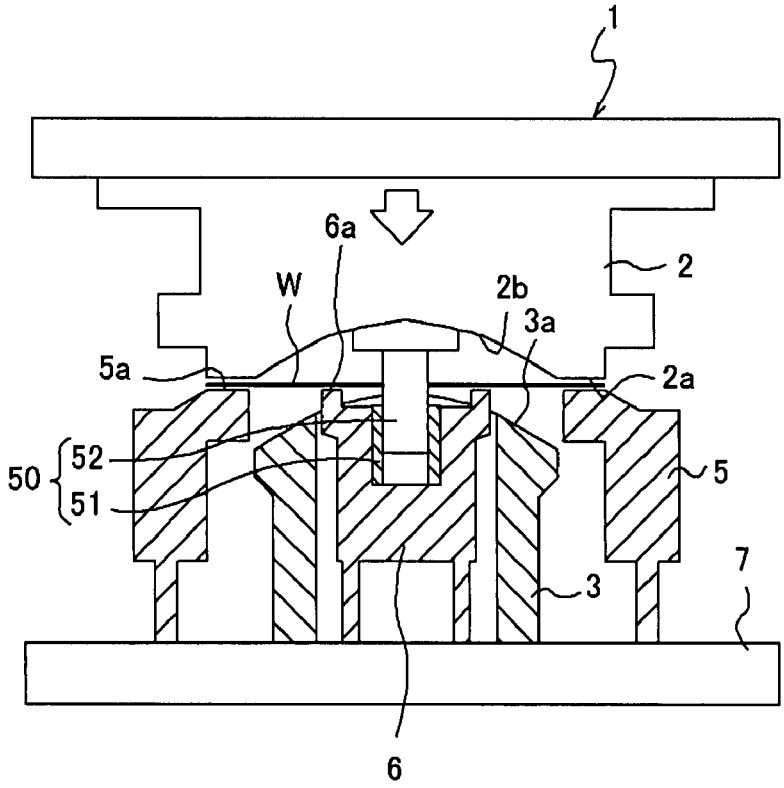
FIG. 1 is a sectional side view of a press molding device according to the present invention.
Figure 2:
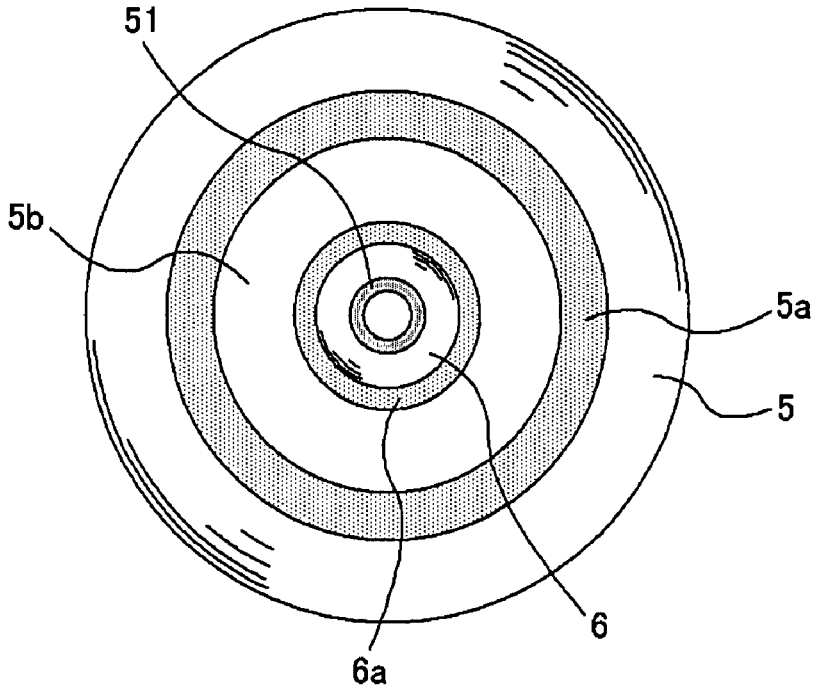
FIG. 2 is a plan view of a first cushion ring and a second cushion ring.
Figure 3:
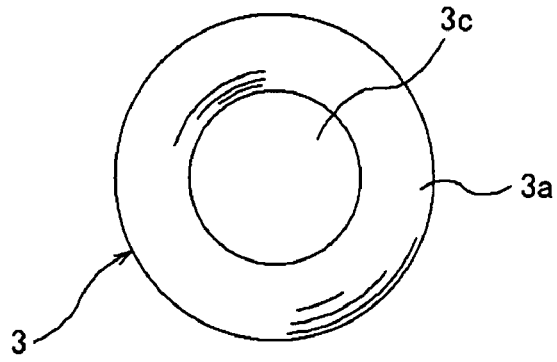
FIG. 3 is a plan view of a punch.

A press molding device 1 shown in FIGS. 1 to 3 performs draw forming and comprises a die 2 as an upper mold, a punch 3 facing the die 2 (arranged below the die 2 in FIG. 1), a first cushion ring 5 which is a ring-shaped member arranged around the punch 3, and a second cushion ring 6 arranged at the inner peripheral side of the first cushion ring 5.

The die 2 can be driven vertically, and the first cushion ring 5 and the second cushion ring 6 can follow the die 2 (that is, the cushion rings can be moved vertically following the vertical movement of the die 2).

The first cushion ring 5, the second cushion ring 6 and the punch 3 are mounted on a bolster 7.

The first cushion ring 5 is arranged so as to cover the outer perimeter of the punch 3. A void 3*c* is formed in the punch 3 and the second cushion ring 6 is fitted into the void 3*c*.

In other words, the punch 3 is arranged in a space 5*b* between the first cushion ring 5 and the second cushion ring 6 and is shaped corresponding to the shape of the space 5*b*.

The first cushion ring 5 and the second cushion ring 6 can be slid vertically against the punch 3.

A pressure surface 5*a* and a pressure surface 6*a* are formed respectively on the upper surfaces of the first cushion ring 5 and the second cushion ring 6. On the lower surface of the die 2, a pressure surface 2*a* is formed at the position corresponding to the pressure surfaces 5*a* and 6*a* of the first and second cushion rings 5 and 6. The pressure surface 2*a* can touch the pressure surfaces 5*a* and 6*a*.

In addition, the part of the pressure surface 2*a* corresponding to the pressure surface 5*a* of the first cushion ring 5 is arranged at the outer peripheral part of the die 2.

The second cushion ring 6 has a reinforcing structure 50 which suppresses disorder of posture of the second cushion ring 6.

In detail, a guide post 52 which is a columnar member is fixed to the die 2 and projected downward. Furthermore, a guide bush 51 which is a tubular member is fixed to the second cushion ring 6, and the guide post 52 is slidably inserted into the guide bush 51.

Then, the guide bush 51 and the guide post 52 constitute the reinforcing structure 50 of the second cushion ring 6.

A tabular work piece W which is a processed member is interposed between the die 2 and the punch 3. In the case that the work piece W is processed by the press molding device 1, firstly, the die 2 is moved downward so that the work piece W is pinched by the pressure surface 2*a* of the die 2 and the pressure surface 5*a* of the first cushion ring 5 (the state shown in FIG. 1). In this state, the work piece W is also pinched by the pressure surface 6*a* of the second cushion ring 6 and the pressure surface 2*a* of the die 2.

Figure 4:
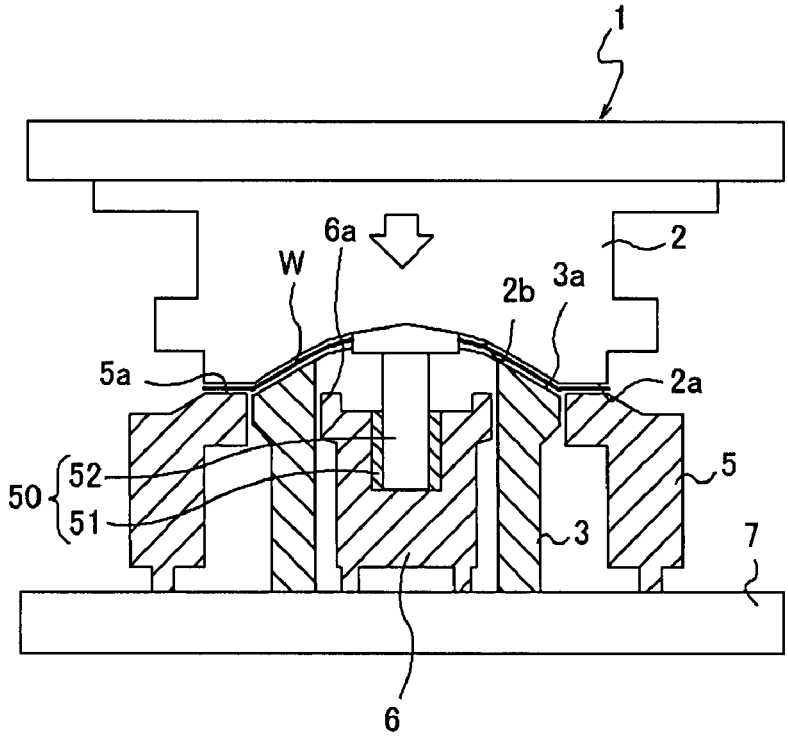
FIG. 4 is a sectional side view of the press molding device molding a work piece.
Figure 5:
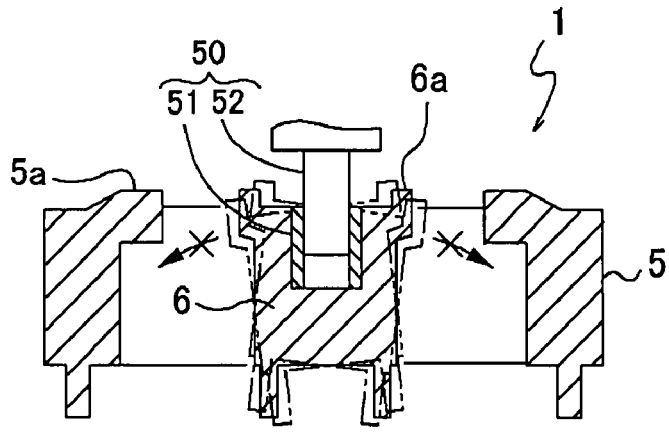
FIG. 5 is a sectional side view of a reinforcing structure suppressing disarrangement of posture of the second cushion ring.

Then, the die 2 is moved downward further so that the work piece W is pressed to a processing surface 3*a* of the punch 3 and is deformed, whereby the work piece W is processed to be molded. As shown in FIG. 4, the work piece W is pinched completely by the processing surface 3*a* of the punch 3 and a processing surface 2*b* of the die 2 so as to finish the processing.

At this time, the first cushion ring 5 and the second cushion ring 6 are moved downward with the die 2 while pinching the work piece W.

In the case that the work piece W is molded while the die 2 is moved downward as mentioned above, the guide post 52 inserted into the guide bush 51 is slid downward along the guide bush 51 following the downward movement of the die 2.

The guide post 52 projected downward is fixed to the die 2. The outer diameter of the guide post 52 and the inner diameter of the guide bush 51 are formed to be adjusted their dimension so as to prevent the ricketiness and make the slide smooth in the case of inserting the guide post 52 into the guide bush 51. Accordingly, in the case that the guide post 52 is inserted into the guide bush 51, the movement and slant of the second cushion ring 6 in lateral direction is restricted and only the slide in vertical direction is permitted.

As was previously mentioned, the guide bush 51 is fixed to the second cushion ring 6, the guide post 52 is fixed to the die 2, and the guide post 52 is slidably inserted into the guide bush 51 so as to constitute the reinforcing structure 50 of the second cushion ring 6. Accordingly, at the time of molding process of the work piece W, even if force to the horizontal direction is applied on the second cushion ring 6 by the inflow of the work piece W following the process or the effect of arrangement of cushion pins, the disorder of posture of the second cushion ring 6 such as lateral movement or slant is suppressed, thereby preventing abnormal abrasion of the punch 3 and the die 2 and defects of the work piece W after processed such as crease and crack.

Accordingly, the crease and crack of the work piece W after the molding process can be suppressed without troublesome adjustment work or the like, thereby improving the accuracy of molding process and quality of the work piece W.

Figure 6:
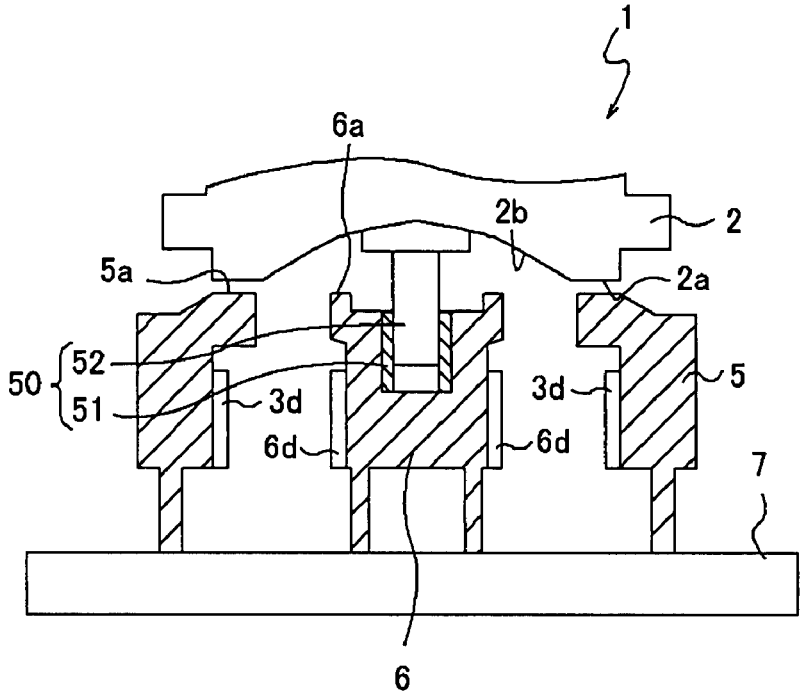
FIG. 6 is a sectional side view of a slide plate attached to the second cushion ring.

Now, as shown in FIG. 6, slide plates 3*d* and 6*d* which are guide members for vertical movement are respectively attached to the first cushion ring 5 and the second cushion ring 6. Since the disorder of posture of the second cushion ring 6 is suppressed and behavior thereof is stabilized at the time of molding process of the work piece W, partial abrasion of the slide plate 6*d* is prevented, thereby extending life of the construction members of the press molding device 1 such as the slide plate 6*d*.

In the case that the reinforcing structure 50 is constructed between the die 2 and the second cushion ring 6, by inserting the guide post 52 into the guide bush 51 at the time of attaching the die 2 to the press molding device 1, the guide post 52 serves as a guide of attachment of the die 2, thereby easing the attachment work of the die 2.

Since the reinforcing structure 50 is constructed by the guide bush 51 fixed to the second cushion ring 6 and the guide post 52 fixed to the die 2, the disorder of posture of the second cushion ring 6 to the horizontal direction such as lateral movement or slant is suppressed effectively with simple construction.

Figure 7:
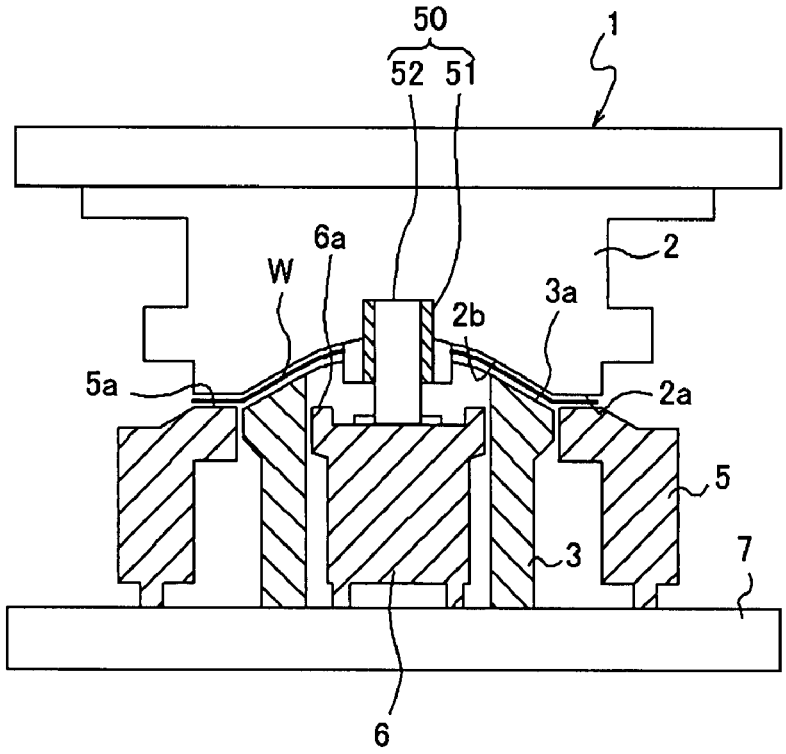
FIG. 7 is a sectional side view of a press molding device that a guide bush is provided on a die and a guide post is provided on the second cushion ring so as to constitute a reinforcing structure.

With regard to the press molding device 1 shown in FIGS. 1 to 5, the guide bush 51 is fixed to the second cushion ring 6 and the guide post 52 is fixed to the die 2 so that the reinforcing structure 50 is provided between the die 2 and the second cushion ring 6. However, as shown in FIG. 7, it may alternatively be constructed that the guide bush 51 is fixed to the die 2 and the guide post 52 is fixed to the second cushion ring 6 so that the reinforcing structure 50 is provided between the die 2 and the second cushion ring 6.

Furthermore, the reinforcing structure 50 may alternatively be provided between the second cushion ring 6 and the bolster 7 as discussed below.

Figure 8:
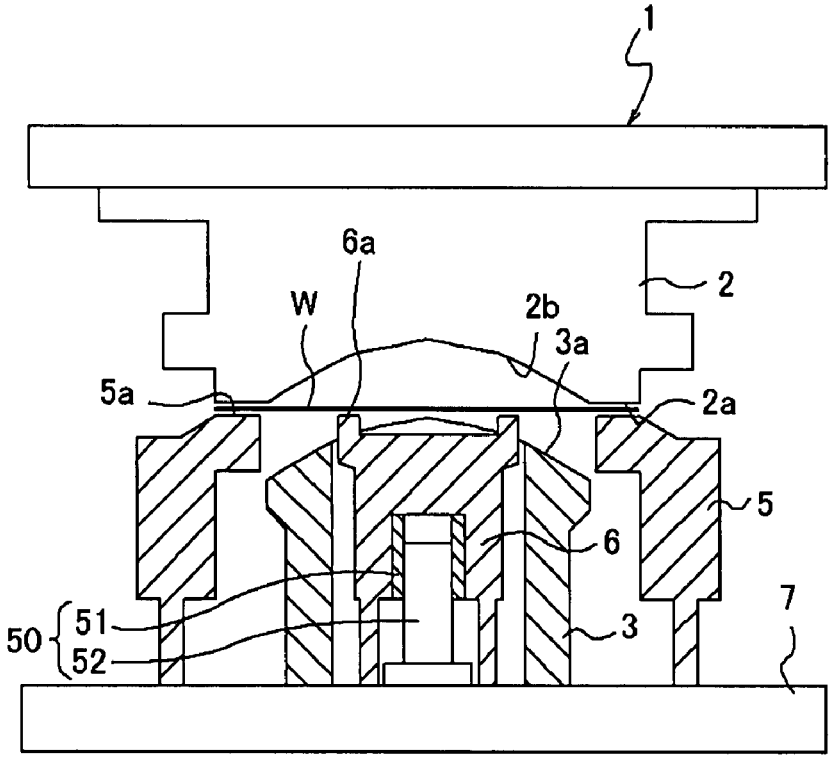
FIG. 8 is a sectional side view of a press molding device that a guide bush is provided in the second cushion ring and a guide post is provided in a bolster so as to constitute a reinforcing structure.

Namely, as shown in FIG. 8, the guide post 52 is fixed to the bolster 7 and projected upward, the guide bush 51 is fixed to the lower portion of the second cushion ring 6, and the guide post 52 is slidably fitted with the guide bush 51 so as to construct the reinforcing structure 50.

Figure 9:
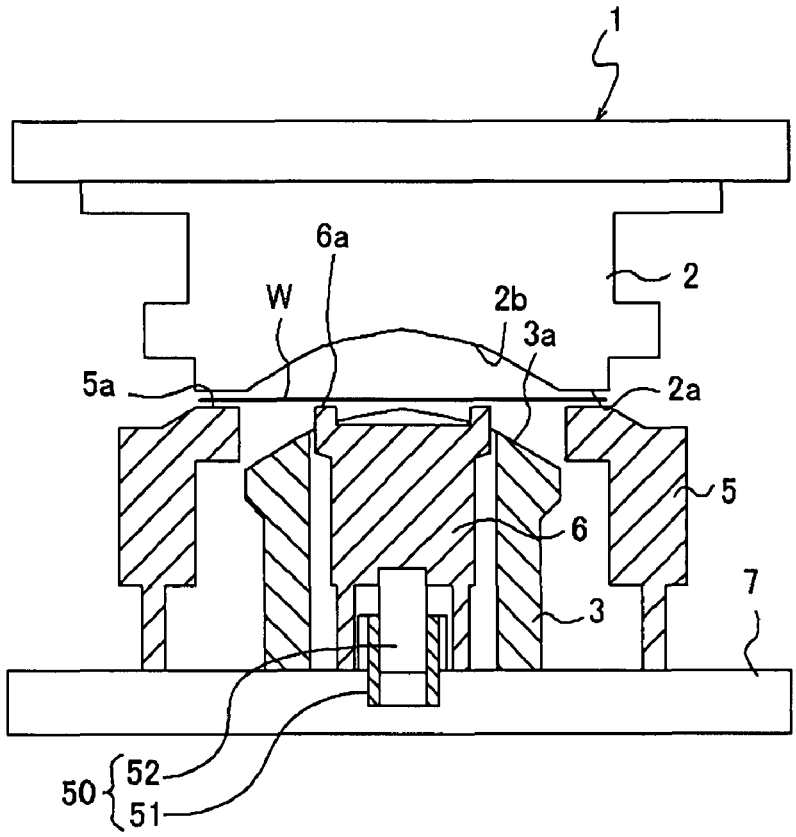
FIG. 9 is a sectional side view of a press molding device that a guide bush is provided in a bolster and a guide post is provided in the second cushion ring so as to constitute a reinforcing structure.

In the case that the reinforcing structure 50 is provided between the second cushion ring 6 and the bolster 7, as shown in FIG. 9, it may alternatively be constructed that the guide post 52 is fixed to the second cushion ring 6 and the guide bush 51 is fixed to the bolster 7 so as to construct the reinforcing structure 50.

Also in the case that the reinforcing structure 50 is provided between the second cushion ring 6 and the bolster 7, even if force to the horizontal direction is applied on the second cushion ring 6 at the time of molding process of the work piece W, the guide bush 51 and the guide post 52 fitted with each other suppress the disorder of posture of the second cushion ring 6 to the horizontal direction such as lateral movement or slant. Accordingly, abnormal abrasion of the punch 3 and the die 2 and defects of the work piece W after processed such as crease and crack are prevented.

Accordingly, the crease and crack of the work piece W after the molding process can be suppressed without troublesome adjustment work or the like, thereby improving the accuracy of molding process and quality of the work piece W.

In the case that the reinforcing structure 50 is provided between the second cushion ring 6 and the bolster 7, by inserting the guide post 52 into the guide bush 51 at the time of attaching the second cushion ring 6 to the bolster 7, the guide post 52 serves as a guide of attachment of the second cushion ring 6, thereby easing the attachment work of the die 2.

Figure 10:
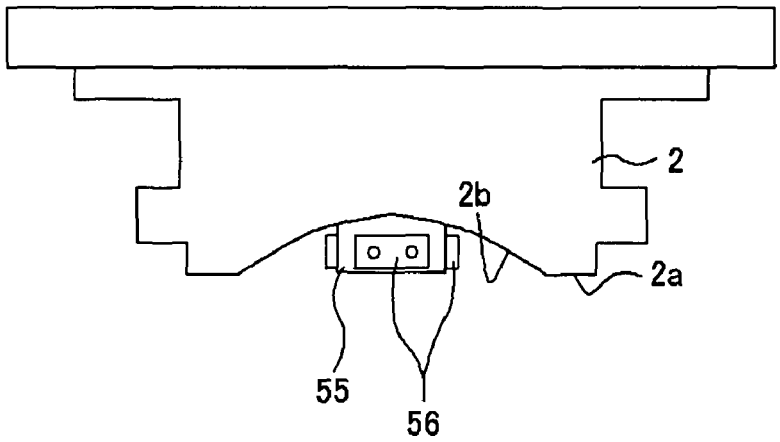
FIG. 10 is a sectional side view of a press molding device that a slide plate is attached to a die so as to constitute a reinforcing structure.
Figure 11:
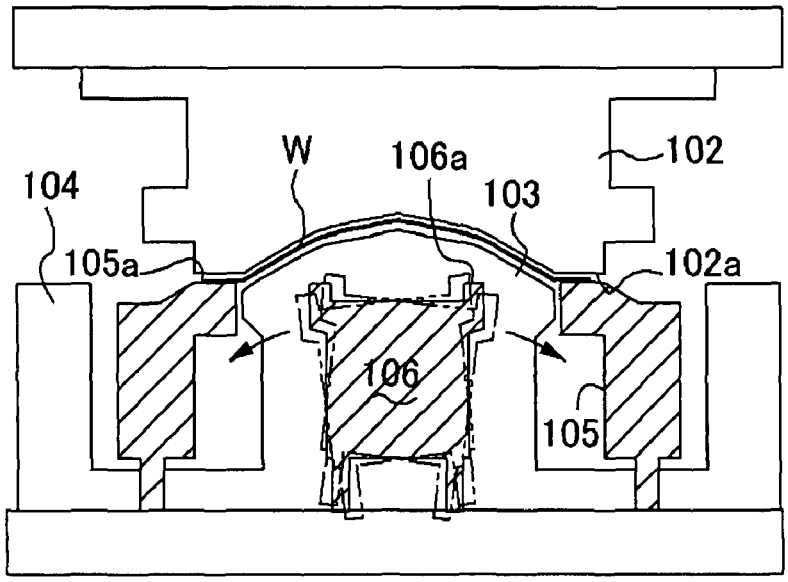
FIG. 11 is a sectional side view of a conventional press molding device.

The reinforcing structure 50 may alternatively be constructed as shown in FIG. 10.

For example, as shown in FIG. 10, it may alternatively be constructed that an attachment basal part 55 is fixed to the die 2, slide plates 56 are attached to the side surfaces of the attachment basal part 55, receiving parts for the slide plates 56 are formed on the second cushion ring 6, and the slide plates 56 of the die 2 are slidably abut against the receiving parts of the second cushion ring 6, thereby constructing the reinforcing structure 50.

Also in this case, even if force to the horizontal direction is applied on the second cushion ring 6 at the time of molding process of the work piece W, the reinforcing structure 50 constructed by the slide plates 56 of the die 2 and the receiving parts of the second cushion ring 6 suppresses the disorder of posture of the second cushion ring 6 to the horizontal direction such as lateral movement or slant. Accordingly, abnormal abrasion of the punch 3 and the die 2 and defects of the work piece W after processed such as crease and crack are prevented.

Accordingly, the crease and crack of the work piece W after the molding process can be suppressed without troublesome adjustment work or the like, thereby improving the accuracy of molding process and quality of the work piece W.

INDUSTRIAL APPLICABILITY

The present invention can be used for molding process of a work piece by a press molding device having a die, a punch and a cushion ring.

The invention claimed is:

1. A press molding device comprising: a die, a punch, and a cushion ring arrangement including a first cushion ring and a second cushion ring, wherein:

the first cushion ring is disposed around the punch;

the punch has a void which houses the second cushion ring, the second cushion ring being configured to move vertically; and the device further comprises a reinforcing structure configured to maintain posture of the second cushion ring in the horizontal direction, the reinforcing structure including a guide bush and a guide post, the guide bush being located within the second cushion ring for slidably supporting the guide post.

2. The press molding device according to claim 1, wherein the guide post is fixedly attached to the die.

3. The press molding device according to claim 1, wherein the guide post is fixedly attached to a bolster on which the second cushion ring is mounted.

4. A press molding method using a press molding device comprising: a die, a punch, and a cushion ring arrangement including a first cushion ring and a second cushion ring, wherein:

the first cushion ring is disposed around the punch;

the punch has a void which houses the second cushion ring, the second cushion ring being configured to move vertically; and the device further comprises a reinforcing structure configured to maintain posture of the second cushion ring in the horizontal direction, the reinforcing structure including a guide bush and a guide post, the guide bush being located within the second cushion ring for slidably supporting the guide post.

5. The press molding method according to claim 4, wherein the guide post is fixedly attached to the die.

6. The press molding method according to claim 4, wherein the guide post is fixedly attached to a bolster on which the second cushion ring is mounted.

7. A press molding device comprising: a die, a punch, and a cushion ring arrangement including a first cushion ring and a second cushion ring, wherein:

the first cushion ring is disposed around the punch;

the punch has a void which houses the second cushion ring, the second ring being configured to move vertically; and the device further comprises a reinforcing structure configured to maintain posture of the second cushion ring in the horizontal direction, the reinforcing structure including a guide bush and a guide post, the guide bush being located within the die for slidably supporting the guide post, the guide post being fixedly attached to the second cushion ring.

* * * * *